US006234273B1

(12) United States Patent
Moore

(10) Patent No.: US 6,234,273 B1
(45) Date of Patent: May 22, 2001

(54) ADJUSTABLE LADDER

(76) Inventor: Graham Moore, 6 River Walk, Walton-on-Thames, Surrey KT12 2DS (GB)

( * ) Notice: Subject to any disclaimer, the term of this patent is extended or adjusted under 35 U.S.C. 154(b) by 0 days.

(21) Appl. No.: 09/466,086

(22) Filed: Dec. 17, 1999

(51) Int. Cl.[7] ..... E06C 7/44
(52) U.S. Cl. ..... 182/204; 182/201
(58) Field of Search ..... 182/201, 204, 182/205

(56) References Cited

U.S. PATENT DOCUMENTS

| | | | | |
|---|---|---|---|---|
| D. 359,365 | | 6/1995 | Greene et al. . | |
| 2,451,113 | | 10/1948 | Ozols . | |
| 2,503,626 | * | 4/1950 | Mayberry | 182/205 X |
| 3,179,206 | * | 4/1965 | Studer | 182/205 |
| 3,374,860 | * | 3/1968 | Stewart | 182/204 |
| 3,791,487 | * | 2/1974 | Baumann | 182/201 |
| 3,878,918 | | 4/1975 | Basile . | |
| 3,882,966 | * | 5/1975 | Fasano | 182/205 |
| 4,128,139 | | 12/1978 | Cook, Sr. . | |
| 5,154,257 | * | 10/1992 | Mirles | 182/201 |
| 5,273,133 | | 12/1993 | Thocher et al. . | |
| 5,307,900 | * | 5/1994 | Noga | 182/204 |
| 5,853,065 | * | 12/1998 | Hutson et al. | 182/204 X |

* cited by examiner

*Primary Examiner*—Daniel P. Stodola
*Assistant Examiner*—Hugh B. Thompson

(57) ABSTRACT

A adjustable ladder for leveling a ladder on an uneven surface. The adjustable ladder includes a ladder and leveling system. The ladder has a first leg, a second leg, and a plurality of rungs extending between the legs. A bottom end of the first leg is hollow and defines a cavity therein. An extension leg extends the length of the first leg. The extension leg comprises a housing which is slidably received in the cavity of the first leg and is adapted to selectively move inward and outward of the cavity for increasing and decreasing an effective length of the first leg. A plurality of bores are located in the first wall of the housing. Each of the bores in the first wall has a diametrically opposed and axially aligned bore in a second wall of the housing. A pin for selectively locking the housing in position with respect to the first leg is insertable through a pair of diametrically opposed bores in the first leg. The opposing bores in the housing and the opposing bores in the first leg are aligned for inserting the pin therethrough for locking the housing.

7 Claims, 1 Drawing Sheet

ADJUSTABLE LADDER

BACKGROUND OF THE INVENTION

1. Field of the Invention

The present invention relates to adjustable ladders and more particularly pertains to a new adjustable ladder for leveling a ladder on an uneven surface.

2. Description of the Prior Art

The use of adjustable ladders is known in the prior art. More specifically, adjustable ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,273,133; 4,128,139; 2,451,113; 2,894,670; 3,878,918; and U.S. Pat. Des. No. 359,365.

While these devices fulfill their respective, particular objectives and requirements, the aforementioned patents do not disclose a new adjustable ladder. The inventive device includes a ladder and leveling system. The ladder has a first leg, a second leg, and a plurality of rungs extending between the legs. A bottom end of the first leg is hollow and defines a cavity therein. An extension leg extends the length of the first leg. The extension leg comprises a housing which is slidably received in the cavity of the first leg and is adapted to selectively move inward and outward of the cavity for increasing and decreasing an effective length of the first leg. A plurality of bores are located in the first wall of the housing. Each of the bores in the first wall has a diametrically opposed and axially aligned bore in a second wall of the housing. A pin for selectively locking the housing in position with respect to the first leg is insertable through a pair of diametrically opposed bores in the first leg. The opposing bores in the housing and the opposing bores in the first leg are aligned for inserting the pin therethrough for locking the housing.

In these respects, the adjustable ladder according to the present invention substantially departs from the conventional concepts and designs of the prior art, and in so doing provides an apparatus primarily developed for the purpose of leveling a ladder on an uneven surface.

SUMMARY OF THE INVENTION

In view of the foregoing disadvantages inherent in the known types of adjustable ladders now present in the prior art, the present invention provides a new adjustable ladder construction wherein the same can be utilized for leveling a ladder on an uneven surface.

The general purpose of the present invention, which will be described subsequently in greater detail, is to provide a new adjustable ladder apparatus and method which has many of the advantages of the adjustable ladders mentioned heretofore and many novel features that result in a new adjustable ladder which is not anticipated, rendered obvious, suggested, or even implied by any of the prior art adjustable ladders, either alone or in any combination thereof.

To attain this, the present invention generally comprises a ladder and leveling system. The ladder has a first leg, a second leg, and a plurality of rungs extending between the legs. A bottom end of the first leg is hollow and defines a cavity therein. An extension leg extends the length of the first leg. The extension leg comprises a housing which is slidably received in the cavity of the first leg and is adapted to selectively move inward and outward of the cavity for increasing and decreasing an effective length of the first leg. A plurality of bores are located in the first wall of the housing. Each of the bores in the first wall has a diametrically opposed and axially aligned bore in a second wall of the housing. A pin for selectively locking the housing in position with respect to the first leg is insertable through a pair of diametrically opposed bores in the first leg. The opposing bores in the housing and the opposing bores in the first leg are aligned for inserting the pin therethrough for locking the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new adjustable ladder apparatus and method which has many of the advantages of the adjustable ladders mentioned heretofore and many novel features that result in a new adjustable ladder which is not anticipated, rendered obvious, suggested, or even implied by any of the prior art adjustable ladders, either alone or in any combination thereof.

It is another object of the present invention to provide a new adjustable ladder which may be easily and efficiently manufactured and marketed.

It is a further object of the present invention to provide a new adjustable ladder which is of a durable and reliable construction.

An even further object of the present invention is to provide a new adjustable ladder which is susceptible of a low cost of manufacture with regard to both materials and labor, and which accordingly is then susceptible of low prices of sale to the consuming public, thereby making such adjustable ladder economically available to the buying public.

Still yet another object of the present invention is to provide a new adjustable ladder which provides in the apparatuses and methods of the prior art some of the advantages thereof, while simultaneously overcoming some of the disadvantages normally associated therewith.

Still another object of the present invention is to provide a new adjustable ladder for leveling a ladder on an uneven surface.

Yet another object of the present invention is to provide a new adjustable ladder which includes a ladder and leveling system. The ladder has a first leg, a second leg, and a plurality of rungs extending between the legs. A bottom end of the first leg is hollow and defines a cavity therein. An extension leg extends the length of the first leg. The extension leg comprises a housing which is slidably received in the cavity of the first leg and is adapted to selectively move inward and outward of the cavity for increasing and decreasing an effective length of the first leg. A plurality of bores are located in the first wall of the housing. Each of the bores in the first wall has a diametrically opposed and axially aligned bore in a second wall of the housing. A pin for selectively locking the housing in position with respect to the first leg is insertable through a pair of diametrically opposed bores in the first leg. The opposing bores in the housing and the opposing bores in the first leg are aligned for inserting the pin therethrough for locking the housing.

Still yet another object of the present invention is to provide a new adjustable ladder that contains a level for determining exactly when the rungs of the ladder are level.

Even still another object of the present invention is to provide a new adjustable ladder that can be leveled efficiently with the turn of a handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
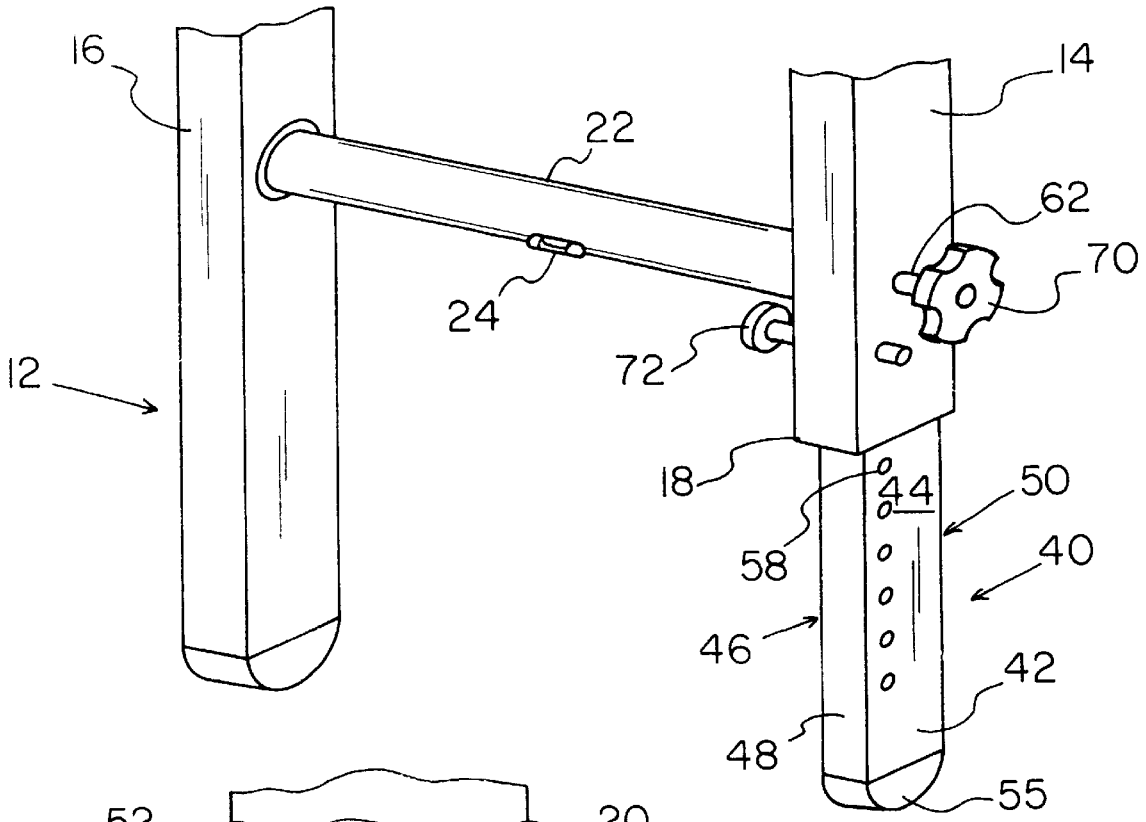
FIG. 1 is a schematic perspective view of a new adjustable ladder according to the present invention.
Figure 2:
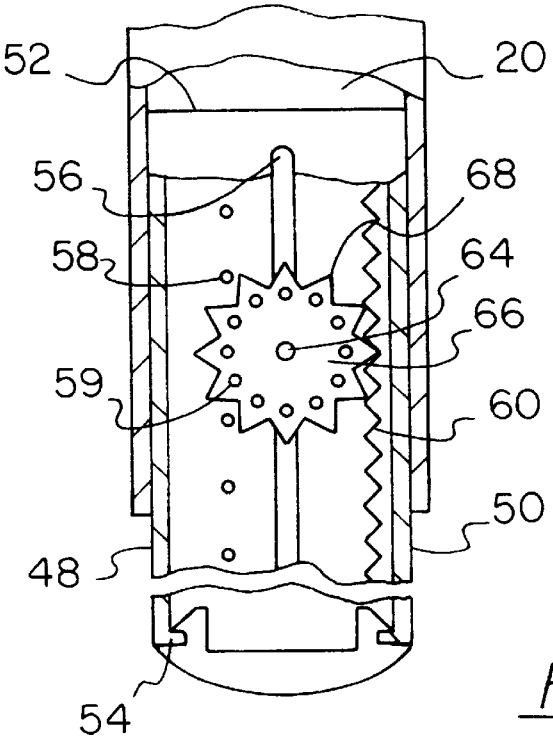
FIG. 2 is a schematic cross-sectional side view of the present invention.

With reference now to the drawings, and in particular to FIGS. 1 and 2 thereof, a new adjustable ladder embodying the principles and concepts of the present invention and generally designated by the reference numeral 10 will be described.

As best illustrated in FIGS. 1 and 2, the adjustable ladder 10 generally comprises a ladder 12 and leveling system 40. The ladder 12 has a first leg 14, a second leg 16, and a plurality of rungs extending between the legs. The first and second legs each have a top end, not shown, and a bottom end 18. The bottom end of the first leg 14 is hollow and defines a cavity 20 therein. The first and second legs each have a substantially rectangular cross-section transverse to a longitudinal axis of the first and second legs. The rung located nearest to the bottom end of the ladder is a first rung 22.

Ideally, a level device 24 determines when the rungs are horizontal. The level device has a generally cylindrical shape, is hollow, and is substantially filled with liquid such that a bubble of gas is trapped in the level device. The level device is transparent in order to view the bubble. The level device is mounted to the first rung 22, and is orientated such that a longitudinal axis of the level device is parallel to a longitudinal axis of the rung. Preferably, the level device 24 is generally adjacent to a longitudinal midpoint of the first rung 22. Ideally, the level device is mounted on a portion of the surface of the first rung which is directed toward the bottom end to thereby protect the level device from being stepped on by a foot stepping on the rung.

An extension leg extends the length of the first leg. The extension leg comprises a housing 42 slidably received in the cavity 20 of the first leg 14 and is adapted to selectively move outward of the cavity for increasing and decreasing an effective length of the first leg. The housing 42 is generally hollow, and has a length and a width adapted for permitting the housing to be slidably received in the cavity 20 of the first leg. The housing has a first 44, second 46, third 48 and fourth walls 50. The first 44 and second walls 46 are opposing walls and the third 48 and fourth walls 50 are opposing walls. The second wall 46 is located generally in a direction toward the second leg 16 of the ladder. The housing has a first end 52 and second end 54. The first end is positioned within the first leg 14 and the second end extends outside of the first leg. Preferably, the second end has a foot 55 thereon. The housing is generally rectangular.

Preferably, a slot 56 is located in the first wall of the housing. The slot extends along a length of the housing between the first end 52 and the second end 54 of the housing. The slot 56 is oriented generally parallel to a longitudinal axis of the first leg 14.

A plurality of bores 58 are located in the first wall 44 of the housing. The bores are positioned generally adjacent to the third wall 48 of the housing, and each of the bores in the first wall has an axially aligned bore in the second wall 46.

Ideally, a plurality of notches 60 are formed on an inner surface of the fourth wall 50.

Preferably, a shaft 62 extends through the slot and through a bore in the first leg substantially adjacent to the bottom end 18 of the first leg 14. The shaft 62 has a first end 64 and a second end, not shown. The first end 64 of the shaft is located in the housing.

Preferably, a gear 66 is fixedly coupled to the first end 64 of the shaft 62. The gear 66 is generally circular. A plurality of teeth 68 radially extends from the periphery of the gear. The teeth 68 are in communication with the notches 50. The gear 66 has a plurality of bores 59 each of the which is positioned adjacent to the periphery of the gear 66.

Preferably, a handle 70 is fixedly coupled to the second end of the shaft 62. Turning of the handle 70 turns the gear 66, wherein turning of the gear extends and retracts the housing 42 with respect to the first leg.

A pin 72 selectively locks the housing in position with respect to the first leg 14. The pin is insertable through a pair of diametrically opposed bores in the first leg such that the pin is generally orientated parallel to the shaft 62. The opposing bores 58 in the housing and one of the bores 59 in the gear are alignable for inserting the pin therethrough for locking the gear and the housing against movement.

In using the preferred embodiment, the ladder is placed on the ground. The housing 42 is extended and retracted from the first leg until the level 24 shows that the ladder is level. At the level point, the pin 72 is inserted through the aligned bores to lock the housing 42 with respect to the first leg 14 of the ladder.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A ladder and leveling system, comprising:

a ladder, said ladder having a first leg, a second leg, and a plurality of rungs extending between said legs, a bottom end of said first leg being hollow and defining a cavity therein;

an extension leg for extending a length of said first leg, said extension leg comprising:

a housing slidably received in the cavity of said first leg and being adapted to selectively move inward and outward of said cavity for increasing and decreasing an effective length of said first leg;

a plurality of bores, each of said bores being located in a first wall of said housing, each of said bores in said first wall having an diametrically opposed and axially aligned bore in a second wall of said housing;

a pin for selectively locking said housing in position with respect to said first leg, said pin being insertable through a pair of diametrically opposed bores in said first leg, wherein said opposing bores in said housing and said opposed bores in said first leg are aligned for inserting said pin therethrough for locking said housing;

said housing being generally hollow, said housing having a length and a width adapted for permitting said housing to be slidably received in said cavity of said first leg, said housing having a first, second, third and fourth wall, said first and second walls being opposing walls and said third and fourth walls being opposing walls, said second wall being located generally in a direction toward said second leg of said ladder, said housing having a first end and second end, said first end being positioned within said first leg and said second end extending outside of said first leg, said housing being generally rectangular;

a slot, said slot being located in said first wall of said housing, said slot extending along a length of said housing between said first end and said second end of said housing, said slot being oriented generally parallel to a longitudinal axis of said first leg;

said plurality of bores being positioned generally adjacent to said third wall of said housing;

a plurality of notches, said notches being formed on an inner surface of said fourth wall;

a shaft, said shaft extending through said slot and through a bore in said first leg substantially adjacent to said bottom end of said first leg, said shaft having a first end and a second end, said first end of said shaft being located in said housing;

a gear being fixedly coupled to said first end of said shaft, said gear being generally circular, said gear having a periphery, a plurality of teeth radially extend from the periphery of said gear, said teeth being in communication with said notches, said gear having a plurality of bores therein, each of said bores in said gear being positioned adjacent to said periphery of said gear;

a handle being fixedly coupled to said second end of said shaft;

wherein said pin is generally orientated parallel to said shaft, wherein said opposing bores in said housing and one of said bores in said gear are alignable for inserting said pin therethrough for locking said gear and said housing against movement.

2. The ladder and leveling system as in claim 1, wherein said first and second legs each have a substantially rectangular cross-section transverse to a longitudinal axis of said first and second legs.

3. The ladder and leveling system as in claim 1, wherein a rung of said plurality of said rungs located nearest to said bottom end of said ladder is a first rung; and further comprising:

a level device for determining when said rungs are horizontal, said level device having a generally cylindrical shape, said level device being hollow, said level device being substantially filled with liquid such that a bubble of gas is trapped in said level device, said level device being transparent, said level device being mounted to said first rung, said level device being orientated such that a longitudinal axis of said level device is parallel to a longitudinal axis of said rung.

4. A ladder and leveling system, comprising:

a ladder, said ladder having a first leg, a second leg, and a plurality of rungs extending between said legs, said first and second legs each having a top end and a bottom end, said bottom end of said first leg being hollow and defining a cavity therein, said first and second legs each having a substantially rectangular cross-section transverse to a longitudinal axis of said first and second legs, wherein a rung of said plurality of said rungs located nearest to said bottom end of said ladder is a first rung;

a level device for determining when said rungs are horizontal, said level device having a generally cylindrical shape, said level device being hollow, said level device being substantially filled with liquid such that a bubble of gas is trapped in said level device, said level device being transparent, said level device being mounted to said first rung, said level device being orientated such that a longitudinal axis of said level device is parallel to a longitudinal axis of said rung, said level device being generally adjacent to a longitudinal midpoint of said first rung, said level device being mounted on a portion of the surface of said first rung which is directed toward said bottom end to thereby protect said level device from being stepped on by a foot stepping on said rung;

an extension leg for extending a length of said first leg, said extension leg comprising:

a housing slidably received in the cavity of said first leg and being adapted to selectively move inward and outward of said cavity for increasing and decreasing an effective length of said first leg, said housing being generally hollow, said housing having a length and a width adapted for permitting said housing to be slidably received in said cavity of said first leg, said housing having a first, second, third and fourth wall, said first and second walls being opposing walls and said third and fourth walls being opposing walls, said second wall being located generally in a direction toward said second leg of said ladder, said housing having a first end and second end, said first end being positioned within said first leg and said second end extending outside of said first leg, said housing being generally rectangular;

a slot, said slot being located in said first wall of said housing, said slot extending along a length of said housing between said first end and said second end of said housing, said slot being oriented generally parallel to a longitudinal axis of said first leg;

a plurality of bores, each of said bores being located in said first wall of said housing, said bores being positioned generally adjacent to said third wall of said housing, each of said bores in said first wall having an axially aligned bore in said second wall;

a plurality of notches, said notches being formed on an inner surface of said fourth wall;

a shaft, said shaft extending through said slot and through a bore in said first leg substantially adjacent to said bottom end of said first leg, said shaft having a first end and a second end, said first end of said shaft being located in said housing;

a gear being fixedly coupled to said first end of said shaft, said gear being generally circular, said gear having a periphery, a plurality of teeth radially extend from the periphery of said gear, said teeth being in communication with said notches, said gear having a plurality of bores therein, each of said bores in said gear being positioned adjacent to said periphery of said gear;

a handle being fixedly coupled to said second end of said shaft;

wherein turning of said handle turns said gear, wherein turning of said gear extends and retracts said housing with respect to said first leg;

a pin for selectively locking said housing in position with respect to said first leg, said pin being insertable through a pair of diametrically opposed bores in said first leg such that said pin is generally orientated parallel to said shaft, wherein said opposing bores in said housing and one of said bores in said gear are alignable for inserting said pin therethrough for locking said gear and said housing against movement.

5. A ladder and leveling system, comprising:

a ladder having a first leg, a second leg, and a plurality of rungs extending between said legs, a bottom end of said first leg having a cavity formed therein;

an extension leg for extending a length of said first leg, said extension leg comprising:

a housing slidably received in the cavity of said first leg and being adapted to selectively move inward and outward of said cavity for increasing and decreasing an effective length of said first leg, said housing being generally hollow and having first, second, third and fourth walls, said first and second walls being opposing walls and said third and fourth walls being opposing walls;

a plurality of bores, each of said bores being located in a first wall of said housing, each of said bores in said first wall having an diametrically opposed and axially aligned bore in a second wall of said housing;

a pin for selectively locking said housing in position with respect to said first leg, said pin being insertable through a pair of diametrically opposed bores in said first leg, wherein said opposing bores in said housing and said opposed bores in said first leg are alignable for inserting said pin therethrough for locking said housing;

a slot located in said first wall of said housing, said slot extending along a length of said housing and being oriented generally parallel to a longitudinal axis of said first leg;

a plurality of notches being formed on an inner surface of said fourth wall;

a shaft extending through said slot and through a bore in said first leg, said shaft having a first end and a second end;

a gear being fixedly coupled to said first end of said shaft, said gear being generally circular and having a periphery, a plurality of teeth radially extend from the periphery of said gear, said teeth being in communication with said notches, said gear having a plurality of bores therein, each of said bores in said gear being positioned adjacent to said periphery of said gear;

wherein said opposing bores in said housing and one of said bores in said gear are alignable for inserting said pin therethrough for locking said gear and said housing against movement.

6. The ladder and leveling system as in claim 5, wherein said first and second legs each have a substantially rectangular cross-section transverse to a longitudinal axis of said first an d second legs.

7. The ladder and leveling system as in claim 5, wherein a rung of said plurality of said rungs located nearest to said bottom end of said ladder is a first rung; and further comprising a level device for determining when said rungs are horizontal, said level device having a generally cylindrical shape, said level device being hollow, said level device being substantially filled with liquid such that a bubble of gas is trapped in said level device, said level device being transparent, said level device being mounted to said first rung, said level device being orientated such that a longitudinal axis of said level device is parallel to a longitudinal axis of said rung.

* * * * *